US010933294B2

(12) United States Patent
Colling

(10) Patent No.: US 10,933,294 B2
(45) Date of Patent: Mar. 2, 2021

(54) COLLAPSIBLE BATTING CAGE SYSTEM

(71) Applicant: Skywalker Holdings, LLC, Brigham City, UT (US)

(72) Inventor: Michael J. Colling, Brigham City, UT (US)

(73) Assignee: Skywalker Holdings, LLC, Brigham, UT (US)

( * ) Notice: Subject to any disclaimer, the term of this patent is extended or adjusted under 35 U.S.C. 154(b) by 0 days.

(21) Appl. No.: 16/403,266

(22) Filed: May 3, 2019

(65) Prior Publication Data

US 2020/0346092 A1 Nov. 5, 2020

(51) Int. Cl.

| | |
|---|---|
| ***A63B 67/00*** | (2006.01) |
| ***A63B 71/00*** | (2006.01) |
| ***A63B 71/02*** | (2006.01) |
| *A63B 69/00* | (2006.01) |

(52) U.S. Cl.

CPC ..... *A63B 71/022* (2013.01); *A63B 71/023* (2013.01); *A63B 69/0002* (2013.01); *A63B 2069/0008* (2013.01)

(58) Field of Classification Search

CPC ..... A63B 71/022; A63B 71/023; A63B 769/0002; A63B 769/0075; A63B 769/0079; A63B 769/406; A63B 47/025; A63B 2069/0008; A63B 67/002; A63B 24/00

USPC ..... 473/421, 422, 415, 456, 473, 162, 197; 135/97, 121, 124, 127, 128, 145; 273/395, 400; D21/780; D25/1, 18, 19, D25/22, 33

See application file for complete search history.

(56) References Cited

U.S. PATENT DOCUMENTS

| | | | | | |
|---|---|---|---|---|---|
| 1,931,387 | A | * | 10/1933 | Kelliher | A63B 71/022 473/451 |
| 2,922,653 | A | * | 1/1960 | O'Obrien | A63B 63/00 473/197 |
| 3,222,067 | A | * | 12/1965 | Litwhiler | A63B 71/022 473/421 |
| D276,466 | S | * | 11/1984 | Giovagnoli | 473/421 |
| 4,815,736 | A | * | 3/1989 | Wright | A63B 71/022 135/124 |
| 4,890,834 | A | * | 1/1990 | Ponza | A63B 47/025 473/421 |
| 5,056,782 | A | * | 10/1991 | Giovagnoli | A63B 47/025 198/565 |
| 5,335,684 | A | * | 8/1994 | Hanninen | E04H 15/18 135/115 |

(Continued)

*Primary Examiner* — Mitra Aryanpour
(74) *Attorney, Agent, or Firm* — Alliance IP, LLC

(57) ABSTRACT

An apparatus comprises a plurality of upright frames, an upright frame of the plurality of upright frames comprising a first upright segment, a second upright segment, and a lateral segment to connect a first end of the first upright segment to a first end of the second upright segment, a first base segment to couple to a second end of the first upright segment, and a second base segment to couple to a second end of the second upright segment, wherein the first base segment and the second base segment are to interface with a ground surface to support the upright frame in an upright position. The plurality of upright frames are adapted to support a batting cage net when in use and the plurality of upright frames are nestable together or may be placed directly adjacent each other when not in use.

19 Claims, 7 Drawing Sheets

(56) References Cited

U.S. PATENT DOCUMENTS

| | | | | | |
|---|---|---|---|---|---|
| 5,370,385 | A * | 12/1994 | Joy | A63B 71/022 | 473/421 |
| 5,452,896 | A * | 9/1995 | Core | A63B 71/022 | 473/451 |
| 5,634,638 | A * | 6/1997 | Havens | A63B 71/022 | 135/128 |
| 5,730,442 | A * | 3/1998 | Anderson | A63B 71/022 | 273/400 |
| 6,550,491 | B1 * | 4/2003 | Bixler | A63B 71/022 | 135/121 |
| 6,688,256 | B1 * | 2/2004 | King | A01K 1/0245 | 119/474 |
| 7,608,000 | B2 * | 10/2009 | Butler | A63B 24/00 | 473/415 |
| 8,172,703 | B2 * | 5/2012 | Lay | A63B 71/022 | 124/1 |
| D681,846 | S * | 5/2013 | Wenzel | D25/1 | |
| 9,295,899 | B1 * | 3/2016 | Dixon, Jr. | A63B 71/022 | 473/421 |
| 2002/0098920 | A1 * | 7/2002 | Bruyer | A63B 71/022 | 473/421 |
| 2005/0020389 | A1 * | 1/2005 | Peterson | A63B 71/022 | 473/421 |
| 2009/0286631 | A1 * | 11/2009 | Hammons | A63B 69/0002 | 473/455 |
| 2012/0010028 | A1 * | 1/2012 | Hammons | A63B 69/0002 | 473/454 |
| 2014/0221128 | A1 * | 8/2014 | Ferraro | A63B 69/0002 | 473/421 |

* cited by examiner

COLLAPSIBLE BATTING CAGE SYSTEM

BACKGROUND

The present disclosure relates in general to the field of recreational equipment, and more specifically, to collapsible sports enclosures, including batting cages.

A batting cage may include a frame system as well as a net that is supported by the frame system. A batting cage may contain batted balls within the boundary of the cage as the batted balls may strike the net and fall to a ground surface within the confines of the cage.

BRIEF DESCRIPTION OF THE DRAWINGS

Like reference numbers and designations in the various drawings indicate like elements.

DETAILED DESCRIPTION

Figure 1:
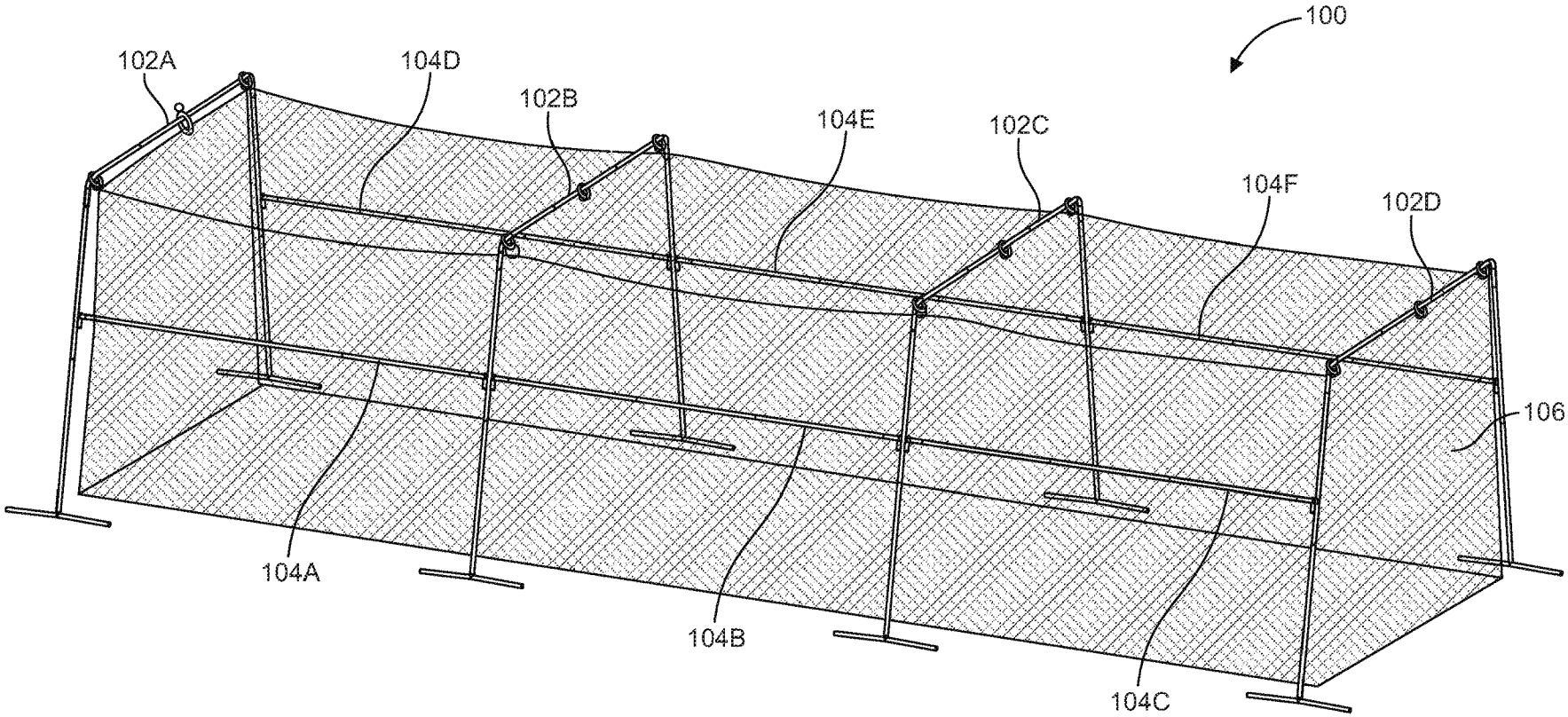
FIG. 1 illustrates a batting cage system in accordance with certain embodiments.

FIG. 1 illustrates a batting cage system 100 in accordance with certain embodiments. System 100 comprises a plurality of upright frames 102 (e.g., 102A-D) coupled together via cross members 104 (e.g., 104A-F). A batting cage net 106 is supported by the resulting frame assembly.

In general, large batting cage systems (e.g., batting cage systems equal to or greater than 30 feet long or 8 feet high) are difficult and time consuming to assemble and disassemble. For example, assembly of a large batting cage system may require the use of tools (such as a ladders, ratchets, wrenches, or the like), multiple people, and a substantial time commitment, rendering the systems suboptimal for applications in which the batting cage system is frequently or semi-frequently assembled and disassembled (e.g., in a backyard application where a homeowners association prohibits permanent installation or a multi-use space).

In various embodiments, system 100 is adapted for relatively quick and easy assembly and disassembly. In one embodiment, an upright frame 102 is a single continuous piece that does not require assembly or that may include smaller segments that are assembled together initially and are not disassembled when the cage system 100 is collapsed. In some embodiments, an upright frame 102 has base segments that allow the upright frame 102 to stand upright without additional lateral support during assembly. For example, the upright frames 102 may be placed in position and left standing in upright positions while a user retrieves cross members 104 or net 106. Accordingly, various embodiments may provide for assembly of the system 100 by a single user. In various embodiments, the base segments of the upright frame 102 may be adapted to slide, roll, or otherwise move across a ground surface (e.g., dirt, lawn, synthetic turf, carpet, or other surface) or within a track system to allow easily placement of the upright frames 102 during assembly of system 100. In some embodiments, the upright frames 102 are adapted to nest together for storage when the system 100 is collapsed.

In various embodiments, the cross members 104 are adapted for easy attachment between upright frames 102. For example, in some embodiments, the point of attachment for a cross member 104 may be low enough on an upright frame 102 that a user may perform the attachment without a ladder or similar tool. As another example, the attachment mechanism may facilitate quick and easy attachment of a cross member 104 to an upright frame 102 (e.g., one end of the cross member 104 may easily slide in, snap to, or otherwise connect with a corresponding coupler of the upright frame 102). Accordingly, various embodiments of the present disclosure may provide a batting cage system that may be assembled and collapsed relatively easily and quickly and may be stored compactly.

In various embodiments, upright frames 102 and cross members 104 may comprise any suitable materials. In general, materials having a high strength-to-weight ratio may be particularly suitable, as such materials may be easily transportable and provide the proper support for the batting cage net 106. As non-limiting examples, such materials may include aluminum, steel, galvanized steel, a plastics-based material such as Polyvinyl Chloride (PVC), or other suitable material. In various embodiments, upright frames 102 or cross members 104 may comprise tubing of any suitable gauge, diameter, or shape (e.g., round, square, rectangular, etc.). Such tubing may be hollow or solid. Other suitable configurations for upright frames 102 and cross members 104 are contemplated herein.

A batting cage net 106 may comprise any suitable material for impeding airborne objects such as baseballs or softballs. For example, net 106 may comprise nylon, polyethylene, polyester, or other suitable material. In some embodiments, the net 106 may be treated with a coating for durability, such as a waterproofing agent or ultra violet (UV) ray inhibitor. In various embodiments, the net 106 may be installed on the inside of the upright frames 102 (e.g., underneath the upright frames 102) or on the outside (e.g., over the top of the upright frames 102). In some embodiments, the net 106 may be secured to the upright frames 102 or cross members 104 using any suitable means, such as ropes, hooks, latches, bungee cords, or other suitable attachment means. In some embodiments, the upright frames 102 may include various attachment mechanisms (e.g., eyelets, hooks, tabs, or other suitable mechanisms) for the net 106 at any suitable points of the upright frames.

Figure 2:
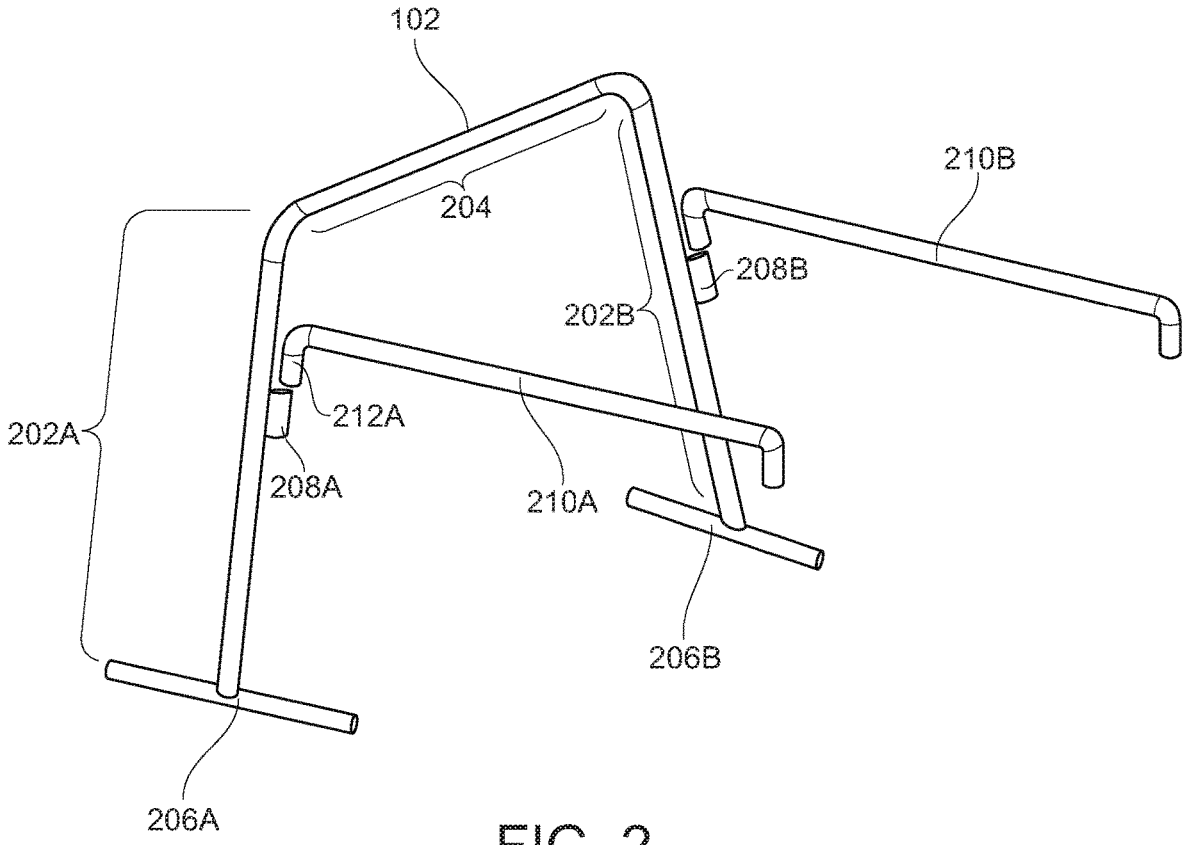
FIG. 2 illustrates an upright frame and two support cross members in accordance with certain embodiments.

FIG. 2 illustrates an upright frame 102 and two support cross members 210 (i.e., 210A and 210B) in accordance with certain embodiments. Support cross members 210 may have any suitable characteristics of support cross members 104 or other support cross members described herein.

In the embodiment depicted, upright frame 102 includes a pair of upright segments 202A and 202B, a lateral segment 204 attached between the upright segments 202A and 202B, and base segments 206A and 206B each attached to a respective upright segment 202. In the embodiment depicted, the general shape of an upright frame 102 (including the ground surface underneath the lateral segment as a side) is trapezoidal, though in various embodiments the upright frame 102 may form any suitable shape (e.g., a rectangle, a pentagon, another convex polygon, or other suitable shape).

An upright segment 202 may be a segment of the upright frame 102 that extends longer in a vertical direction than a lateral direction when the upright frame 102 is placed in an upright position upon its base segments 206. In some embodiments, an upright segment 202 may comprise a piece of tubing, rod, parallelepiped, or other segment shape that extends from the base segment 206 at a uniform angle along its length. In some embodiments, the upright segment 202 may rise from the ground surface at a 90 degree angle, while in other embodiments, the upright segment 202 may rise from the ground surface at any suitable angle between 45 and 90 degrees. In the embodiment depicted, the upright segment 202 rises from the ground surface at approximately a 75 degree angle. In various embodiments, an upright segment 202 may include one or more segments disposed at different angles relative to the ground surface. For example, a lower segment of an upright segment 202 may rise from the ground at a 90 degree angle and an adjacent segment of the upright segment 202 may extend from the lower segment at a different angle relative to the ground (e.g., 75 degrees). In various embodiments, an upright segment 202 may be one continuous segment or may comprise multiple segments coupled together. In a particular embodiment, upright segment 202 comprises two or more segments that couple together in a straight-line fashion (such that the angle between the ground and the upright segment 202 is constant along the length of the upright segment 202).

In the embodiment depicted, upright frame 102 comprises a lateral segment 204 disposed between the pair of upright segments 202. The lateral segment 204 may be a segment of the upright frame 102 that extends longer in a lateral direction than a vertical direction when the upright frame 102 is in an upright positions supported by its base segments 206. In some embodiments, a lateral segment 204 may comprise a piece of tubing, rod, parallelepiped, or other segment shape that extends from the upright segment 202 at a uniform angle along its length. In some embodiments, the lateral segment 204 may be generally parallel with the ground surface, though in other embodiments, the lateral segment 204 may be disposed at any angle between 0 and 45 degrees with respect to the ground surface. In various embodiments, a lateral segment 204 may include one or more segments disposed at different angles relative to the ground surface. For example, a first segment of the lateral segment may rise slightly from its point of attachment to an upright segment 202A along its length to an apex and a second segment adjacent to the first segment may descend from the apex down to the point of attachment to other upright segment 202B (e.g., when the upright frame 102 forms a pentagon shape). In various embodiments, a lateral segment 204 may be one continuous segment (which may extend in a straight-line fashion or may include one or more bends or curves) or may comprise multiple segments coupled together.

Lateral segment 204 may be attached to upright segments 202 in any suitable manner. In one example, upright frame 102 is a single continuous piece where the lateral segment 204 is formed along with the upright segments 202A and 202B during manufacturing of the single piece or after manufacture by bending a long straight piece at two or more points to form the lateral segment 204 and the upright segments 202. In another example, lateral segment 204 is a separate piece from the upright segments 202 and is coupled to the upright segments 202A and 202B (e.g., via bolts, machine screws, welds, locking buttons, telescopic compression, pins, or other means of attachment). In a particular embodiment, lateral segment 204 comprises or is coupled to a first elbow segment that has a first end that slides into or over a first end of lateral segment 204 and a second end that slides into or onto a first end of the upright segment 202A. Lateral segment 204 may further comprise or be coupled to a second elbow segment that has a first end that slides into or over a second end of lateral segment 204 and a second end that slides into or onto a first end of the upright segment 202B.

Upright frame 102 may comprise one or more cross member couplings 208 (e.g., 208A and 208B) attached to or integrated with the upright segments 202. The cross member couplings 208 may be adapted to easily attach to the cross members 210 (e.g., 210A and 210B). In various embodiments, the coupling of cross member 210A to upright frame 102 (and subsequent decoupling) may be accomplished in a relatively quick manner so as to facilitate easy assembly and disassembly of the system 100. In various embodiments, the coupling may be performed using human effort without the use of any tools.

In a particular embodiment, a cross member coupling 208A may provide a hollow perimeter into which a first end 212A of a cross member 210 may be slid to complete the attachment. For example, a first end 212A of the cross member may simply be inserted into the cross member coupling 208A by placing the first end 212A over the cross member coupling 208A and dropping or sliding the first end 212A into the cross member coupling 208A. In another embodiment, the first end 212A may comprise a portion of hollow tubing and the cross member coupling 208A may comprise a rod over which the first end 212A may be placed to couple the cross member 210A to the upright frame 102. In various embodiments, cross member coupling 208A may have any suitable solid or hollow shape with an outer perimeter shape matching an inner perimeter shape of the first end 212A. In other embodiments, cross member coupling 208A may have any suitable shape with an inner perimeter shape matching an outer perimeter shape of the first end 212A. In various embodiments, the sizing of the first end 212A and the cross member coupling 208A may be adapted to provide a relatively snug fit between the first end 212A and the cross member coupling 208A while allowing for toolless attachment and detachment of the cross member 210A to the upright frame 102.

In various embodiments, the coupling of cross member 210A to upright frame 102 may be accomplished via any suitable additional or alternative mechanism, such as insertion of a pin or bolt between the upright frame 102 and the cross member 210A.

Cross member Couplings 208 may be placed at any suitable height(s) on the upright segments 202. In a particular embodiment, cross member couplings 208 may be placed at or near the midpoints of the upright segments 202. In various embodiments (such as the one depicted), a cross member coupling 208A on an upright segment 202A is at the same height as a corresponding cross member coupling 208B on the other upright segment 202B.

In general, the coupling between a cross member 210 and two upright frames 102 may be snug enough to provide lateral stability to the two upright frames 102. For example, the one or more cross members 210 placed between upright frames 102 may couple the upright frames 102 together such that lateral force applied to a particular upright frame 102 may be absorbed at least in part by another upright frame 102. In various embodiments, the cross members 210 may also provide support for the batting cage net 106. For example, the net 106 may be placed over or on the inside of the cross members 210 and/or attached to the cross members via ropes, hooks, latches, bungee cords, or other suitable attachment means.

Figure 3:
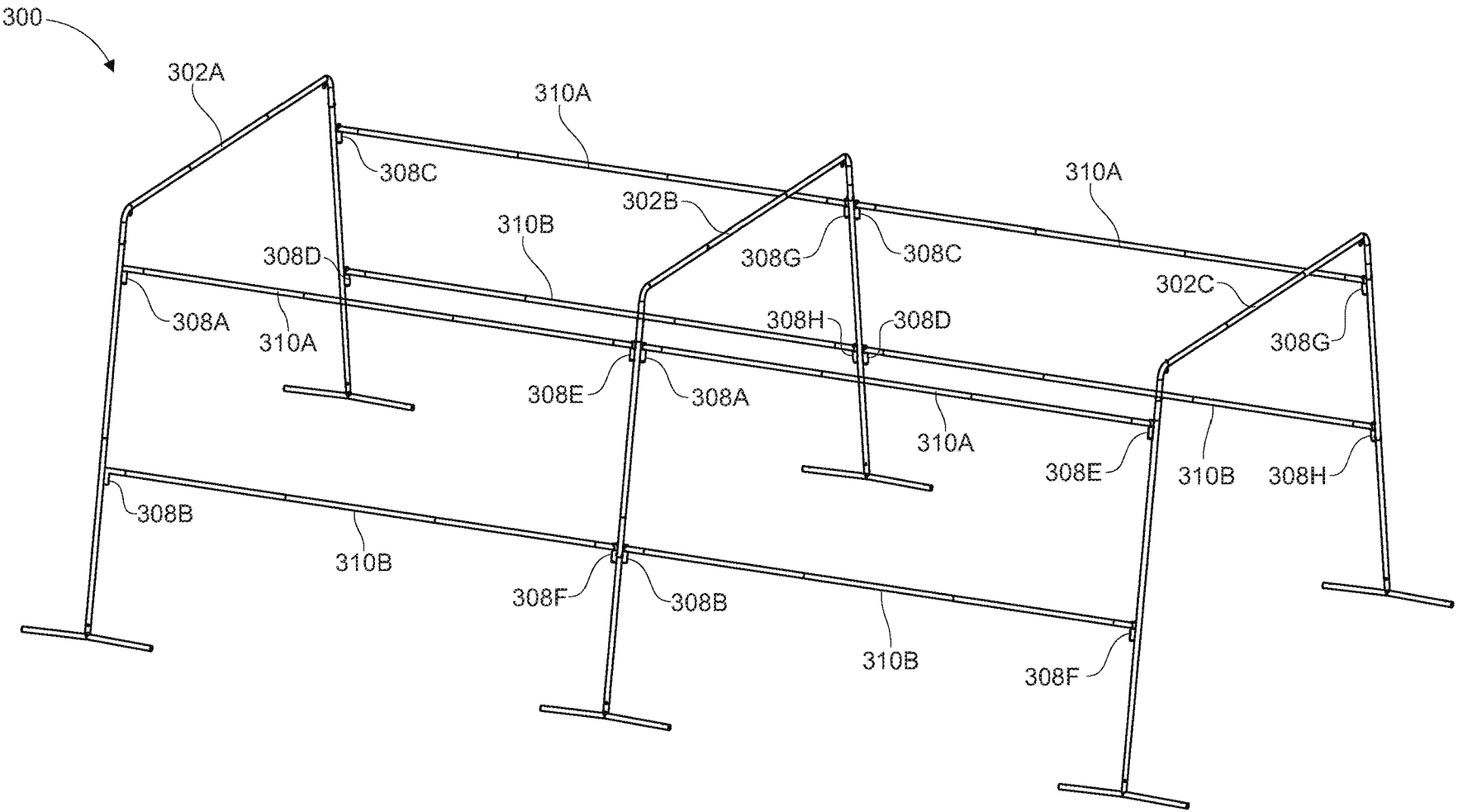
FIG. 3 illustrates upright frames coupled to multiple support cross members at each upright segment in accordance with certain embodiments.

FIG. 3 illustrates upright frames 302 (i.e., 302A-C, which may have any suitable characteristics of upright frames 102 or other upright frames described herein) coupled to multiple support cross members 310A and 310B (which may have any suitable characteristics of cross members 210 or other cross members described herein) at each upright segment 202 in accordance with certain embodiments. In various embodiments (e.g., as depicted in FIG. 3), a first upright segment of an upright frame 302 (e.g., 302A) may comprise multiple cross member couplings 308 (e.g., 308A and 308B) which may have any suitable characteristics of cross member couplings 208 or other cross member couplings described herein) for attachment to multiple cross members 310 (e.g., 310A and 310B). In some embodiments, the other upright segment 202 of the upright frame 302 may comprise corresponding cross member couplings 308 (e.g., 308C and 308D) at equivalent heights. For example, cross member couplings 308A and 308C are at the same height and cross member couplings 308B and 308D are at the same height.

Cross member couplings 308 may be placed at any suitable heights on the upright segments 202. In a particular embodiment, cross member couplings 308A and 308C may be placed at or near two thirds of the length of the upright segments 202 while cross member couplings 308B and 308D may be placed at or near one third of the length of the upright segment 202, although any suitable configuration is contemplated herein.

In some embodiments, an upright segment 202 of an upright frame 302 may include couplings on opposing sides of the upright frame 302 such that two cross members 310 may be attached to the upright frame 302 at the same height. For example, the upright frame 302B includes cross member couplings 308A and 308E on an upright segment 202 at a first height. The upright frame 302B also includes cross member couplings 308B and 308F on the same upright segment 202 at a second height. This same upright frame 302 includes cross member couplings 308C and 308G on the other upright segment 202 at the first height and cross member couplings 308D and 308H on the other upright segment 202 at the second height.

In various embodiments, a batting cage system (e.g., 100 or 300) may include two upright frames (e.g., 102A, 102D, 302A, or 302C) that are adapted to function as end frames. In some embodiments, these upright frames (e.g., 302) have couplings on one side of the upright frame 302, but not both sides, as one or more cross members 310 are attached to only one side of such frames. The system may also include one or more upright frames (e.g., 102B, 102C, or 302B) that are adapted to function as intermediate frames. These frames may include couplings on opposing sides of the same upright segments 202 of the frames such that cross members 310 may be attached to both sides of the upright frames (e.g., 302). Other suitable configurations are contemplated herein. Although a system 300 with a single intermediate frame (302B) is depicted and a system 100 with two intermediate frames (102B, 102C) are depicted, other embodiments may include any suitable number of intermediate upright frames and corresponding cross members.

Figure 4B:
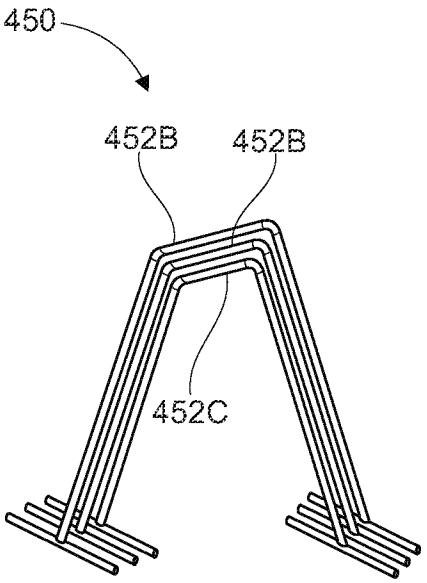
FIGS. 4A-4B illustrate nested upright frames of a batting cage system in accordance with certain embodiments.
Figure 4A:
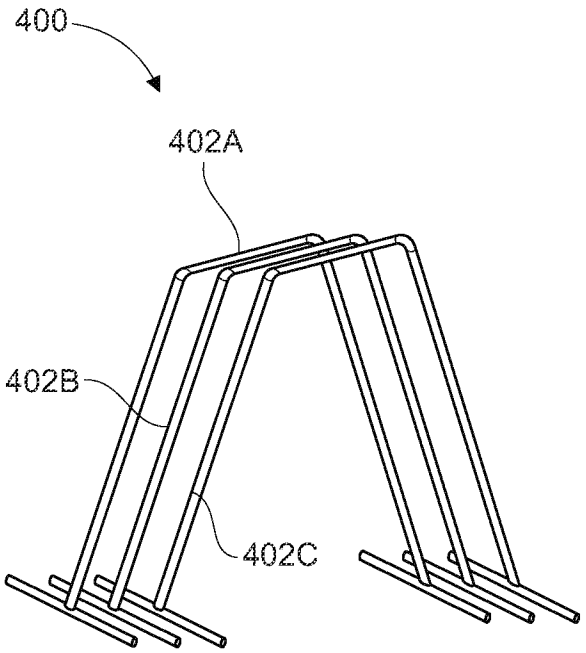
Figure 5A:
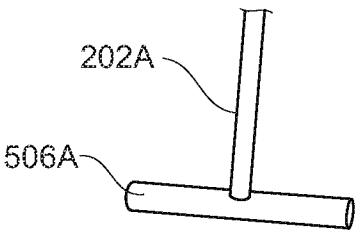
FIGS. 5A-5B illustrate base segments of upright frames in accordance with certain embodiments.
Figure 5B:
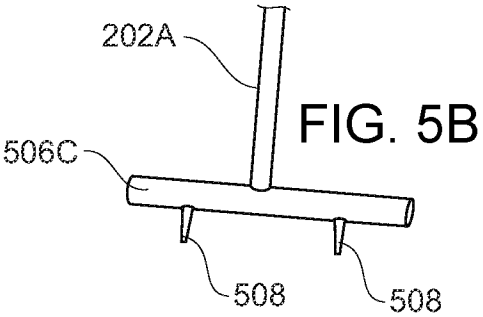
Figure 5C:
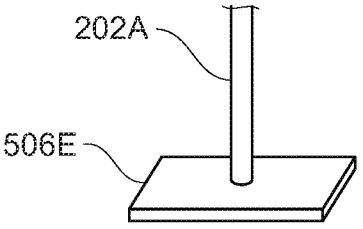
Figure 5D:
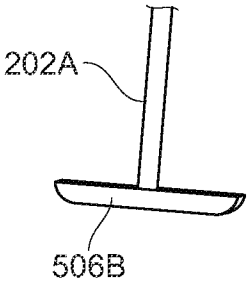
Figure 5E:
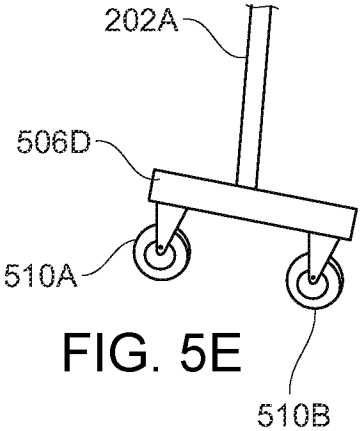
Figure 5F:
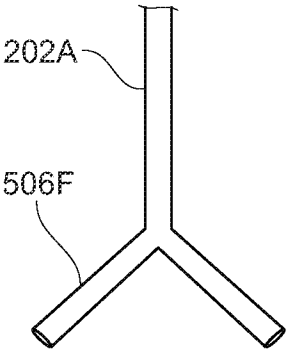

FIGS. 4A-4B illustrates nested upright frames 402A-C and 452A-C of a batting cage system (e.g., 100 or 300) in accordance with certain embodiments. The upright frames 402 and 452 may have any suitable characteristics of uprights frames 102, 302, or other upright frames described herein. In a first nested configuration 400, the upright frames 402A, 402B, and 402C are each the same size. Accordingly, each successive upright frame 402 may rest slightly in front of and to the side of the previous upright frame 402. For example, upright frame 402B rests slightly in front of and to the left of upright frame 402A, and upright frame 402C rests slightly in front of and to the left of upright frame 402B.

In a second nested configuration 450, the upright frames 452A, 452B, and 452C are different sizes and support concentric nesting. For example, the outside upright frame 452A is the largest frame. The middle upright frame 452B is slightly smaller than upright frame 452A. For example, the upright segments 202 of upright frame 452B may extend in the vertical direction slightly less than the upright segments 202 of upright frame 452A and the lateral segment 204 of upright frame 452B may extend in the vertical direction slightly less than the lateral segment 204 of upright frame 452A. Accordingly, when the upright frames 452 are nested, the base segments (e.g., 206 or other base segments described herein) of upright frame 452B may rest in between the base segments 206 of upright frame 452A and the lateral segment 204 of upright frame 452B may rest underneath the lateral segment 204 of upright frame 452A. Similarly, the upright frame 452C may be slightly smaller than upright frame 452B, such that upright frame 452C may nest within upright frame 452B in a manner similar to the nesting of upright frame 452B within upright frame 452A.

FIGS. 5A-5F illustrates various base segments 506 (e.g., 506A-F) of upright frames in accordance with certain embodiments. Each base segment 506 is coupled to an upright segment 202A of an upright frame (e.g., 102, 302, 402, or 452). For example, a portion of the base segment may be disposed in generally the same vertical angle as a corresponding upright segment 202 and may be configured to slide into or over a lower portion of the upright segment. Additionally or alternatively, the base segment 506 may be coupled to the upright segment 202 using a bolt and a nut or other suitable attachment means. Corresponding base segments 506 may be coupled to corresponding upright segments 202B of the upright frame. Each of the depicted upright segments 202 enables the upright frame to be free standing, that is, the upright frame may rest on the base segments 506 in an upright position upon a generally flat ground surface without additional means of lateral support.

Base segment 506A comprises a piece of round tubing which may be coupled to the upright segment 202A in any suitable manner (e.g., one or more welds, bolts, screws, locking buttons, latches, or other attachment means). In other embodiments, the base segment 506 may comprise a piece of rectangular tubing (or tubing of another cross-section shape).

Base segment 506B comprises a sled having a generally flat portion at its bottom and two ends that gradually slope upwards from the bottom portion to the top portion of the base segment 506B. The flat portion of base segment 506B may be of any suitable thickness or material. For example, the flat portion may comprise a piece of tubing similar to base segment 506A or a different shape, such as a flat plate.

Base segment 506C comprises a pair of cleats 508 protruding downward from a substantially flat portion on the lower end of the main portion of the base segment 506C. The cleats 508 may be adapted to be inserted into the ground to prevent the upright frame (e.g., 102, 302, 402, or 452) from shifting laterally. In various embodiments, the cleats 508 may protrude from hollow or solid tubing, a plate, or other suitable component that is a part of base segment 506C.

Base segment 506D comprises a pair of wheels 510. In various embodiments, a base segment 506 may include any suitable number or type of wheels (e.g., caster, pneumatic, rubber, etc.). Base segment 506E comprises a plate having a uniform thickness. While the plate is shown as having square dimensions, the plate may have any suitable shape (e.g., rectangular, circular, or other suitable shape). Base segment 506F comprises a pair of legs that extend at opposite angles from the upright segment 202A. The legs have a flat portion at the bottom to rest upon a generally flat surface.

While specific base segment 506 shapes have been depicted and described herein, other embodiments contemplate other suitable designs for base segments 506. In some embodiments, characteristics of any two or more of the depicted base segments 506 may be integrated within a base segment 506. In various embodiments, any base segment 506 that allows an upright frame (e.g., 102, 302, 402, or 452) to be easily transported by a user across a surface and to stand upright when resting upon the base segments 506 without additional lateral support is contemplated herein.

Figure 6A:
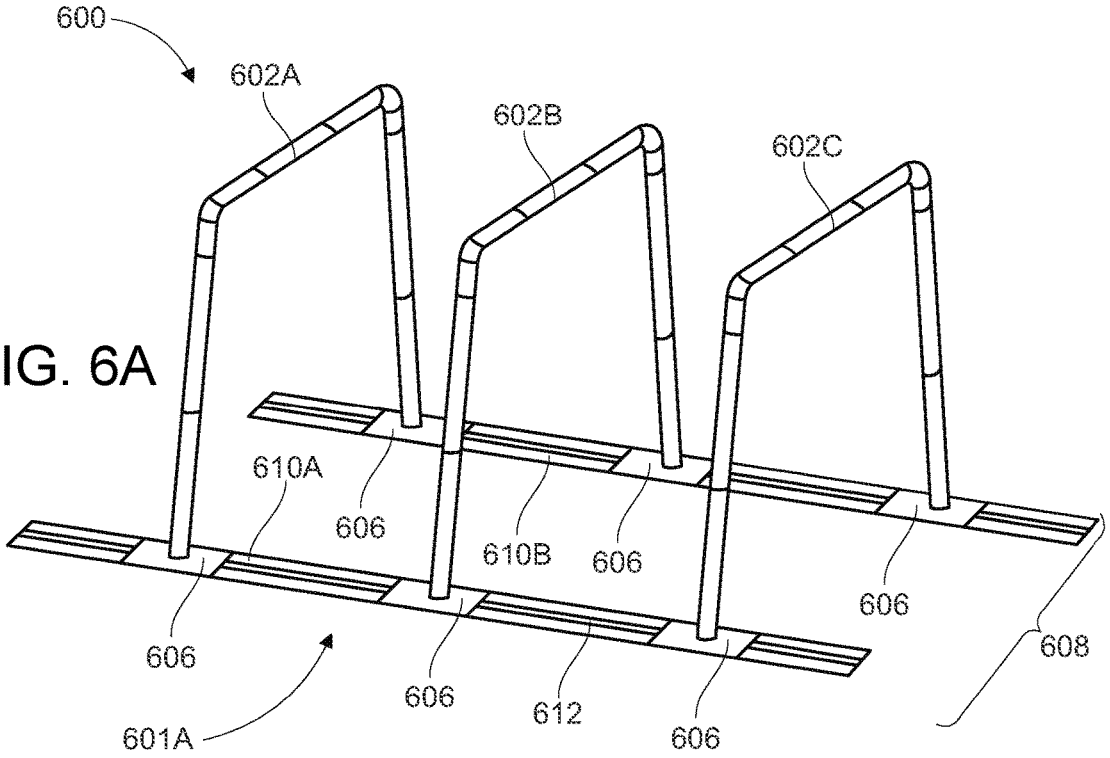
FIGS. 6A-6B illustrate upright frames installed in a track system in accordance with certain embodiments.
Figure 6B:
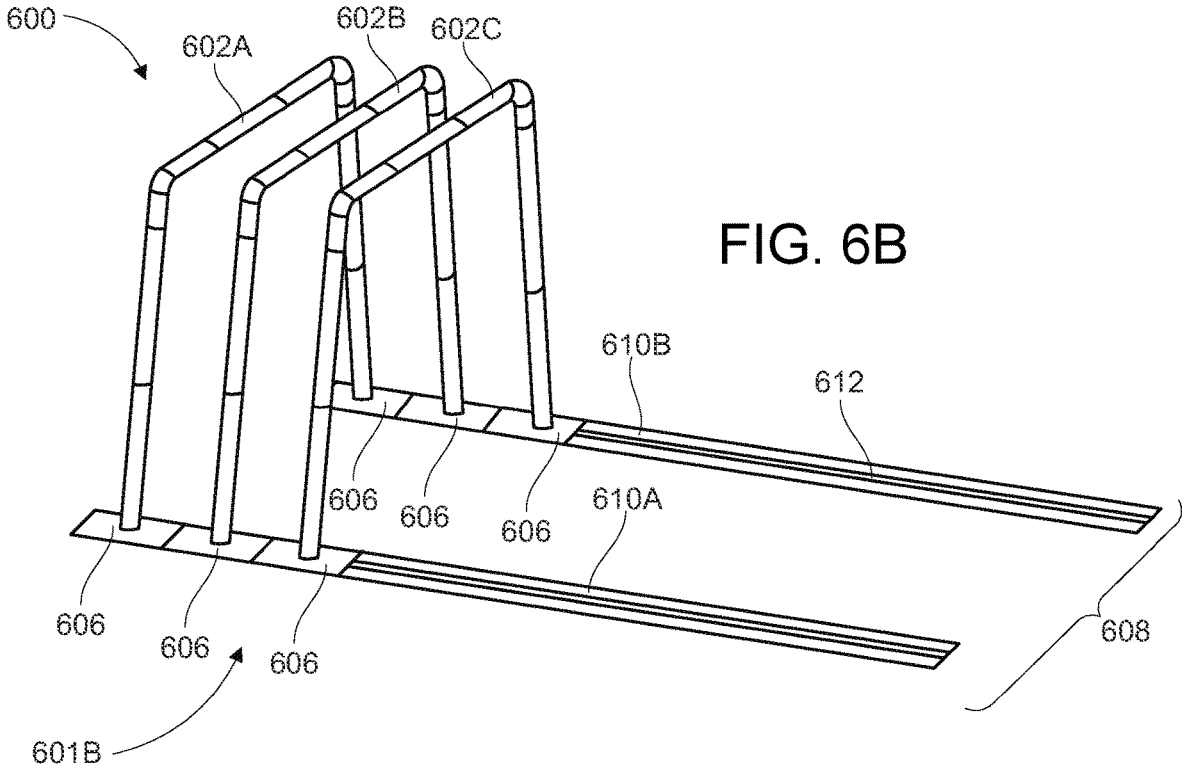

FIGS. 6A-6B illustrates upright frames 602 (e.g., 602A-C) installed within a track system 608 in accordance with certain embodiments. FIG. 6 illustrates a first configuration 601A in which the upright frames 602 are configured for operation (e.g., to support a batting cage net) and a second configuration 601B in which the upright frames 602 are configured for storage. The upright frames 602 may have any of the characteristics of upright frames 102 or other upright frames described herein.

The track system 608 includes a pair of tracks 610 (i.e., 610A and 610B) to guide (e.g., by constraining) the movement of upright frames 602. In this embodiment, the upright frames 602A-C may slide, roll, or otherwise move in a straight line along the tracks 610A and 610B. When the batting cage system 600 is to be stored, the upright frames 602 may be pushed together as shown in configuration 601B, such that the upright frames 602 may be placed directly adjacent each other (for example, the base segments 606 and/or other portions of upright frames may abut together).

In a particular embodiment, tracks 610 may be recessed in the ground. In some embodiments, covers that fill the gaps caused by the tracks 610 may be placed in the tracks 610 to achieve a generally smooth ground surface around and over the tracks 610 such that the space previously occupied by the batting cage system 600 may safely be reclaimed for other activities. The track system 608 may be especially appropriate for an indoor multipurpose environment.

A track 610 may include any suitable mechanism for interacting with base segments 606 of the upright frames 602 to guide the movement of the upright frames 602. In a particular embodiment, each track 610 comprises a rail 612 upon which the base segments 606 are disposed or which otherwise interact with the base segments 606. In some embodiments, the rail may be installed below the ground surface surrounding the tracks 610. For example, the bottom and/or the top of the rail may be disposed beneath the level of the adjacent ground surface.

In one embodiment, base segment 606 may include one or more wheels oriented in the direction of the track 610 to provide the ability to easily roll the upright frame 602 in either direction along the track 610.

In some embodiments, upright frames 602 may include couplings for attachment to cross members. When the cross members are attached to the upright frames 602, the upright frames 602 may be held in place to avoid undesired movement along the tracks 610. For example, the upright frames 602 on the end may abut on edges of the track which prevent them from moving further along the track and the attachment of the cross members may facilitate the placement of the intermediate upright frames 602 such that the proper lateral distance is maintained between upright frames 602.

In some embodiments, upright frames 602 do not include couplings for attachment to cross members. In such embodiments, the track system 608 alone or in combination with other means may provide sufficient lateral stability for the upright frames 602 such that cross members are not needed. As one example, the system 600 may include locking mechanisms for each upright frame 602 to lock the upright frames in place at a certain position in the track.

Figure 7:
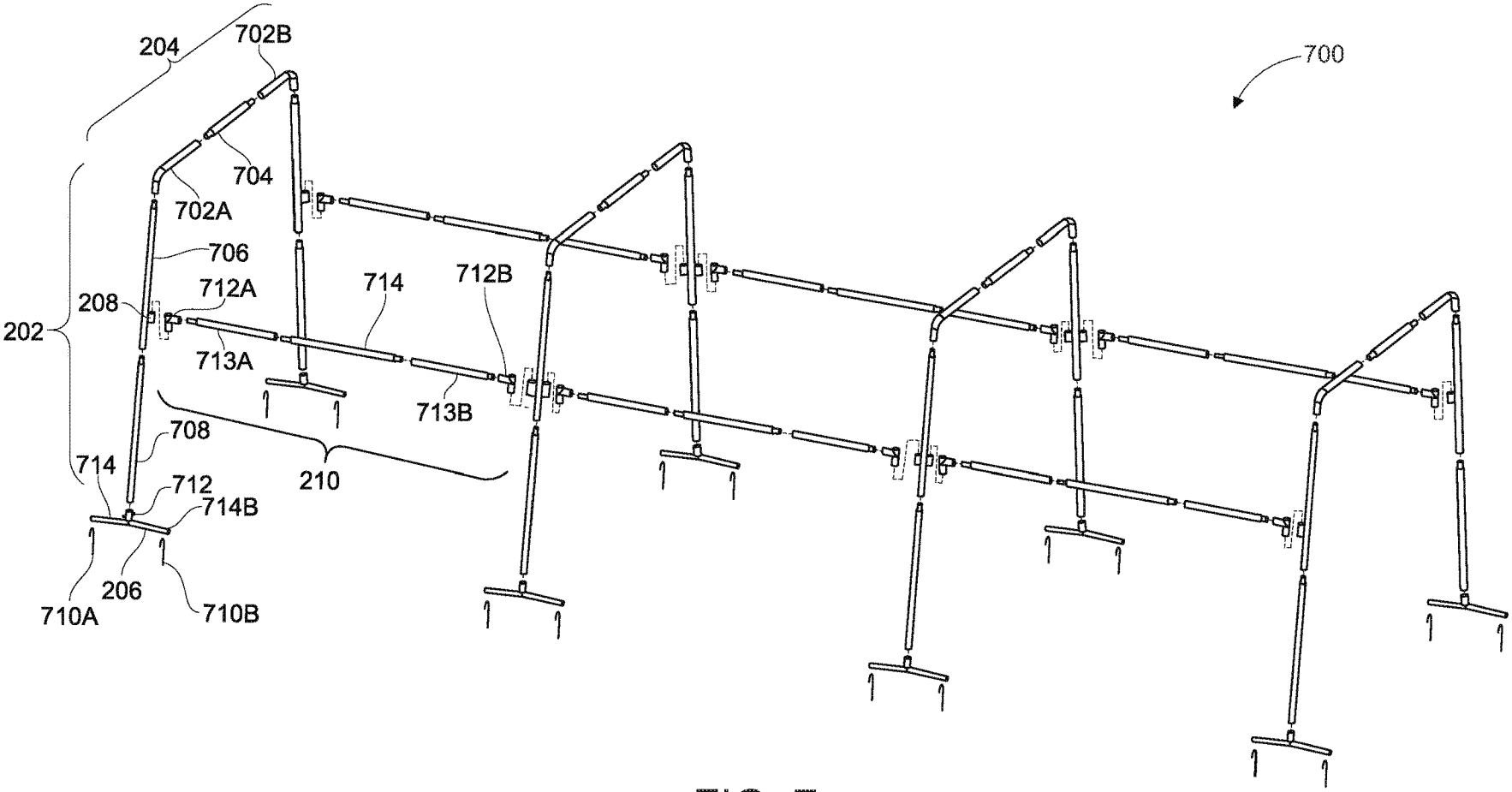
FIG. 7 represents a batting cage frame in accordance with certain embodiments.

FIG. 7 represents a batting cage frame 700 in accordance with certain embodiments. Frame 700 includes four upright frames (e.g., 102) coupled to each other via cross members 210.

In the depicted embodiment, each upright frame (e.g., 102) includes a lateral segment 204 and two upright segments 202. In the embodiment depicted, lateral segment includes a first top frame corner segment 702A, a top frame middle segment 704, and a second top frame corner segment 702B. In a particular embodiment, these segments 702 and 704 are coupled together via bolts and nuts or other suitable attachment means. Each top frame corner segment 702 includes a curved portion in between a first portion that couples to an upright segment 202 and a second portion that couples to top frame middle segment 704.

In the embodiment depicted, each upright segment 202 includes an upper segment 706 that includes a cross member coupling 208 as well as a lower segment 708. In a particular embodiment, these segments 706 and 708 are coupled together via bolts and nuts or other suitable attachment means to form the upright segment 202. The upright segments 202 are coupled to the lateral segment 204 via bolts and nuts or other suitable attachment means.

Base segment 206 includes an upright member 712 that is configured to couple to lower segment 708. In various embodiments a portion of the upright member 712 may slide into or over a portion of the lower segment 708 when the upright member 712 and lower segment 708 are coupled together. Additionally or alternatively, the lower segment 708 may be coupled to the upright member 712 using a bolt and a nut or other suitable attachment means.

In addition to the upright member 712, the base segment 206 includes two lateral segments 714A and 714B that are configured to rest on the ground and support and balance the upright frame (e.g., 102) when the upright frame is fully assembled. The lateral segments may be disposed in a generally perpendicular direction relative to the upright member 712 such that they extend away from the upright member 712 in a lateral direction. In some embodiments (including the embodiment depicted), lateral segments 714A and 714B may extend in a lateral direction away from the inside of the upright frame (e.g., 102), such that an angle (e.g., between 90 degrees and 175 degrees) exists between the lateral segments 714A and 714B. In a particular embodiment, each lateral segment 714 includes an aperture through which a stake 710 may be driven to further secure the base segment 206 to the ground.

Support cross member 210 includes side connection joints 712A and 712B, side connection tube ends 713A and 713B, and side connection tube middle 713B. These components may be coupled together via any suitable attachment means to form support cross member 210. A side connection joint 712 may include one end that slides into or onto cross member coupling 208 and another end that slides into or onto (or otherwise couples to) a side connection tube end 713. In a particular embodiment, side connection joint 712 has an elbow shape.

Any component depicted in FIG. 7 or the other figures may comprise a piece of round, square, or other shape of tubing; a rod, a parallelepiped, or a length of material having any suitable hollow or solid cross section. Any component may be coupled to another component by sliding a portion of the component into or around a portion of another component, via one or more welds, bolts, screws, locking buttons, latches, and/or other attachment means.

It should be appreciated that the particular examples illustrated and discussed above are provided merely to illustrate more general principles of this disclosure. Indeed, it should be appreciated that other features, changes, and alternative embodiments may be implemented without departing from the more general features proposed herein. Reference throughout this specification to "one embodiment" or "an embodiment" means that a particular feature, structure, or characteristic described in connection with the embodiment is included in at least one embodiment of the present disclosure. Thus, the appearances of the phrases "in one embodiment," "in an embodiment," "in one example," "in some examples," "in some instances," etc. in various places throughout this specification are not necessarily all referring to the same embodiment. Furthermore, the particular features, structures, or characteristics may be combined in any suitable manner in one or more embodiments.

The following examples pertain to embodiments in accordance with this disclosure. In accordance with some embodiments, an apparatus comprises a plurality of upright frames, an upright frame of the plurality of upright frames comprising a first upright segment; a second upright segment; a lateral segment to connect a first end of the first upright segment to a first end of the second upright segment; a first base segment to couple to a second end of the first upright segment; a second base segment to couple to a second end of the second upright segment, wherein the first base segment and the second base segment are to interface with a ground surface to support the upright frame in an upright position; and wherein the plurality of upright frames are adapted to support a batting cage net when in use and the plurality of upright frames are nestable together when not in use.

In at least some embodiments, the upright frames are free standing in the upright position when supported by the first and second base segments without additional lateral support. In at least some embodiments, the upright frame is in the upright position, the first upright segment extends further vertically than laterally and the lateral segment extends further laterally than vertically. In at least some embodiments, the apparatus further comprises a cross member, a first end of the cross member to couple to the first upright segment of the upright frame and to a first upright segment of a second upright frame, the cross member to provide lateral stability to the upright frame and the second upright frame. In at least some embodiments, the apparatus further comprises a second cross member, a first end of the second cross member to couple to the first upright segment of the upright frame and to the first upright segment of the second upright frame, the second cross member to provide additional lateral stability to the upright frame and the second upright frame. In at least some embodiments, the first end of the cross member is adapted to be slid in a generally vertical direction to mate with a coupling attached to the first upright segment of the upright frame and the second end of the cross member is adapted to be slid in a generally vertical direction to mate with a coupling attached to the first upright segment of the second upright frame.

In at least some embodiments, a second upright frame of the plurality of upright frames is smaller than the upright frame and a third upright frame of the plurality of upright frames is smaller than the second upright frame, such that when the plurality of upright frames are nested together, the second upright frame nests within the upright frame, and the third upright frame nests within the second upright frame.

In at least some embodiments, the apparatus further comprises a track system comprising a first track and a second track, the first track to be placed parallel to the second track, the first track and the second track to guide movement of the plurality of upright frames. In at least some embodiments, the first track comprises a first rail and the second track comprises a second rail. the first track and second track are to be installed below a ground surface. In at least some embodiments, the apparatus further comprises one or more locking mechanisms to lock the upright frame in place at a desired position along the first track and the second track.

In at least some embodiments, the first base segment comprises a straight edge along a portion of a bottom of the base segment, a first rising edge from the straight edge to a top of the base segment on a first side of the base segment, and a second rising edge from the straight edge to the top of the base segment on a second side of the base segment. In at least some embodiments, the first base segment comprises one or more cleats adapted to penetrate into the ground surface when the upright frame is placed in the upright position. In at least some embodiments, the base segment comprises at least one wheel. In at least some embodiments, the base segment comprises a flat plate. In at least some embodiments, the first base segment comprises a pair of legs protruding at opposite angles from the second end of the first upright segment. In at least some embodiments, the first base segment comprises a piece of tubing for placement perpendicular to the first upright segment.

Thus, particular embodiments of the subject matter have been described. Other embodiments are within the scope of the following claims. In some cases, the features, components, and actions recited in the claims can be arranged or performed in a different manner and still achieve desirable results. In addition, the processes depicted in the accompanying figures do not necessarily require the particular order shown, or sequential order, to achieve desirable results.

A detailed description has been given with reference to specific exemplary embodiments. It will, however, be evident that various modifications and changes may be made thereto without departing from the broader spirit and scope of the invention as set forth in the appended claims. The specification and drawings are, accordingly, to be regarded in an illustrative sense rather than a restrictive sense. Furthermore, the foregoing use of embodiment and other exemplarily language does not necessarily refer to the same embodiment or the same example, but may refer to different and distinct embodiments, as well as potentially the same embodiment.

The invention claimed is:

1. An apparatus comprising:

a plurality of upright frames, an upright frame of the plurality of upright frames comprising:

a first upright segment;

a second upright segment;

a lateral segment to connect a first end of the first upright segment to a first end of the second upright segment;

a first base segment to couple to a second end of the first upright segment;

a second base segment to couple to a second end of the second upright segment, wherein the first base segment and the second base segment are to interface with a ground surface to support the upright frame in an upright position; and a cross member to couple to the first upright segment of the upright frame and to a first upright segment of a second upright frame of the plurality of upright frames, the cross member to provide lateral stability to the upright frame and the second upright frame, the cross member comprising a side connection joint having an elbow shape, wherein the side connection joint is adapted to slide over or into a cross member coupling attached to the first upright segment;

wherein the plurality of upright frames are adapted to support a batting cage net when in use and the plurality of upright frames are nestable together or may be placed directly adjacent each other when not in use.

2. The apparatus of claim 1, wherein the upright frames are free standing in the upright position when supported by the first and second base segments without additional lateral support.

3. The apparatus of claim 1, wherein, when the upright frame is in the upright position, the first upright segment extends further vertically than laterally and the lateral segment extends further laterally than vertically.

4. The apparatus of claim 1, further comprising a cross member, a first end of the cross member to couple to the first upright segment of the upright frame and to a first upright segment of a second upright frame of the plurality of upright frames, the cross member to provide lateral stability to the upright frame and the second upright frame.

5. The apparatus of claim 4, further comprising a second cross member, a first end of the second cross member to couple to the first upright segment of the upright frame and to the first upright segment of the second upright frame, the second cross member to provide additional lateral stability to the upright frame and the second upright frame.

6. The apparatus of claim 4, wherein the first end of the cross member is adapted to be slid in a generally vertical direction to mate with a coupling attached to the first upright segment of the upright frame and the second end of the cross member is adapted to be slid in a generally vertical direction to mate with a coupling attached to the first upright segment of the second upright frame.

7. The apparatus of claim 1, wherein a second upright frame of the plurality of upright frames is smaller than the upright frame and a third upright frame of the plurality of upright frames is smaller than the second upright frame, such that when the plurality of upright frames are nested together, the second upright frame nests within the upright frame, and the third upright frame nests within the second upright frame.

8. The apparatus of claim 1, further comprising a track system comprising a first track and a second track, the first track to be placed parallel to the second track, the first track and the second track to guide movement of the plurality of upright frames and to allow the plurality of upright frames to be placed together when not in use.

9. The apparatus of claim 8, wherein the first track comprises a first rail and the second track comprises a second rail.

10. The apparatus of claim 8, wherein the first track and second track are to be installed below a ground surface.

11. The apparatus of claim 8, further comprising one or more locking mechanisms to lock the upright frame in place at a desired position along the first track and the second track.

12. The apparatus of claim 1, wherein the first base segment comprises a straight edge along a portion of a bottom of the base segment, a first rising edge from the straight edge to a top of the base segment on a first side of the base segment, and a second rising edge from the straight edge to the top of the base segment on a second side of the base segment.

13. The apparatus of claim 1, wherein the first base segment comprises one or more cleats adapted to penetrate into the ground surface when the upright frame is placed in the upright position.

14. The apparatus of claim 1, wherein the base segment comprises at least one wheel.

15. The apparatus of claim 1, wherein the base segment comprises a flat plate.

16. The apparatus of claim 1, wherein the first base segment comprises a pair of legs protruding at opposite angles from the second end of the first upright segment.

17. The apparatus of claim 1, wherein the first base segment comprises a piece of tubing for placement perpendicular to the first upright segment.

18. The apparatus of claim 1, further comprising the batting cage net.

19. The apparatus of claim 1, wherein the first upright segment comprises a piece of tubing, the cross member coupling is attached along a portion of a side of the piece of tubing, and the side connection joint of the cross member mates with the cross member when placed above the cross member coupling and moved downward in a generally vertical direction.

* * * * *